US005467686A

United States Patent [19]

Lipinski

[11] Patent Number: 5,467,686

[45] Date of Patent: Nov. 21, 1995

[54] LINEAR DRIVE WITHOUT A PISTON ROD

[75] Inventor: Reinhard Lipinski, Plochingen, Germany

[73] Assignee: Invest Tech AG, Rotkreuz, Switzerland

[21] Appl. No.: 371,556

[22] Filed: Jan. 11, 1995

[30] Foreign Application Priority Data

Jan. 11, 1994 [DE] Germany ..... 44 00 454.0

[51] Int. Cl.[6] ..... F01B 29/00

[52] U.S. Cl. ..... 92/88; 277/DIG. 7

[58] Field of Search ..... 92/88; 277/DIG. 7

[56] References Cited

U.S. PATENT DOCUMENTS

| | | | |
|---|---|---|---|
| 4,685,383 | 8/1987 | Ruchser | 277/DIG. 7 |
| 4,991,494 | 2/1991 | Migliori | 92/88 |
| 4,998,459 | 3/1991 | Blatt | 92/88 |

FOREIGN PATENT DOCUMENTS

| | | | |
|---|---|---|---|
| 0104364 | 4/1984 | European Pat. Off. | 92/88 |
| 2746718 | 4/1979 | Germany | 277/DIG. 7 |
| 3429783 | 2/1986 | Germany . | |
| 8906987.0 | 9/1989 | Germany . | |

*Primary Examiner*—Thomas E. Denion
*Attorney, Agent, or Firm*—Foley & Lardner

[57] ABSTRACT

A linear drive without a piston rod, which has a laterally slotted guide tube closed on the end faces and a piston mounted so as to be slidably displaceable therein, is provided with a sealing band and with separate profile elements engaging the sealing band. The sealing band extends from one end of the guide tube along its longitudinal slot to its other end. In order to hold the sealing band in the longitudinal slot, separate profile elements are arranged in the longitudinal slot. The profile elements cause the sealing band to engage the guide tube.

21 Claims, 10 Drawing Sheets

LINEAR DRIVE WITHOUT A PISTON ROD

BACKGROUND OF THE INVENTION

The invention relates to a linear drive without a piston rod having a guide tube which has a longitudinal slot leading through its wall and in which a piston is mounted so as to be displaceable in the longitudinal direction.

Linear drives without piston rods generally have a guide tube, in which a piston is mounted in a slidably displaceable and sealed-off manner. To guide the force generated as a result of the action of a pressure medium on the piston out of the guide tube, the latter has a lateral slot, through which a web connected to the piston passes. The slot or longitudinal slot extends at least over the entire path to be covered by the piston and, in general, over the entire length of the guide tube. It is therefore necessary, in order to form pressure-medium chambers, to seal off the longitudinal slot in the regions in which the piston is not exactly standing in each case. A sealing band is used for this purpose, the sealing band bearing on the longitudinal slot from inside and being seated with a portion in the latter. In the region of the piston, the sealing band is lifted off inward from the longitudinal slot, in order to make way for the web which surrounds the sealing band. In order to make it possible for such linear drives actuated by a pressure medium to work reliably, it is necessary for the sealing band to be held near the longitudinal slot, so that it does not sag or fall inward.

DE 3,429,783 A1 discloses a linear-drive cylinder, in which the sealing band sealing off the longitudinal slot has two ribs or lips which are arranged parallel to and at a distance from one another and which pass through the longitudinal slot and are each provided on the end face with a so-called bead. Both the sealing band and the ribs consist of flexible material. The ribs are pretensioned resiliently outward, that is to say away from one another in the spreading direction, and engage with their beads behind the longitudinal slot, in order to fix the sealing band in the longitudinal slot.

In this linear-drive cylinder, the material used for the sealing band determines the spring properties of the lips and therefore how securely the sealing band is held on the guide tube. Moreover, the ribs and beads project from the longitudinal slot, and this must be taken into account when the linear-drive cylinder is installed in machines and plants.

Furthermore, the above-mentioned document laid open for public inspection discloses a linear-drive cylinder, in which the longitudinal slot has flanks which are provided with a longitudinal groove, into which the sealing band engages by means of corresponding longitudinal beads.

Here too, the design of the sealing band and the choice of material for the latter must take into account the desired flexibility required for guiding the sealing band into and out of the longitudinal slot.

Moreover, EP 0,260,344 A3 discloses a pressure-medium cylinder with a longitudinally slotted guide tube, in which a sealing band bearing from inside on the guide tube near the longitudinal slot cooperates by catching with a covering band bearing from outside on the longitudinal slot. For this purpose, the sealing band has two outwardly directed longitudinal webs which extend parallel to and at a distance from one another and are curved slightly away from one another and which between them limit an interspace. The sealing band engages into this interspace by means of a rib provided in one piece on the sealing band and pointing radially inward, a clamping or catching connection being obtained as a result of the inclination of the faces which are in contact with one another.

In this pressure-medium cylinder, the covering band is additionally required as well as the sealing band. Both bands have to be lifted off from the longitudinal slot near the web and the web must be guided around the two bands.

Moreover, it is known from the above-mentioned patent application to hold the sealing band and covering band together by means of a magnetic strip, corresponding ferromagnetic steel bands being provided both in the sealing band and in the covering band.

In this embodiment of a pressure-medium cylinder, in addition to the sealing band and the covering band, the magnetic strip also has to be lifted out from the longitudinal slot, in order to allow passage to the web connected to the piston.

SUMMARY OF THE INVENTION

An object of the invention is to provide a linear drive without a piston rod, which allows a simple leading of the web through the longitudinal slot and in which the sealing band is held securely in the longitudinal slot.

The above-mentioned object is achieved by means of a linear drive comprising a guide tube having a longitudinal slot defined therein by at least one flank, and at least one closing device for closing an end face of the guide tube; a piston mounted in the guide tube and displaceable in a longitudinal direction; a web connected to the piston and passing through the longitudinal slot; a sealing band for sealing the longitudinal slot at least in pressurized regions and which is held fixedly at end faces relative to the guide tube, at least one portion of the sealing band being seated in the longitudinal slot; and at least one separate profile element disposed in the longitudinal slot and extending essentially along a longitudinal extension of the flank of the longitudinal slot; wherein the profile element is connected to the sealing band such that a catching connection is formed between the sealing band and the guide tube.

Preferably, the flank of the longitudinal slot includes at least one groove and the profile element includes a portion seated in the groove.

Advantageously, a side of the sealing band facing the flank of the longitudinal slot includes a longitudinal recess extending over an entire length of the sealing band, and the profile element includes a catch portion which extends into the longitudinal recess.

Further objects, features, and advantages will become apparent from the following detailed description taken in conjunction with the accompanying drawing.

BRIEF DESCRIPTION OF THE DRAWING

The drawing is hereby expressly made a part of the specification.

Exemplary embodiments of the invention are illustrated in the drawing. In this.

DETAILED DESCRIPTION OF THE PREFERRED EMBODIMENTS

Figure 1:
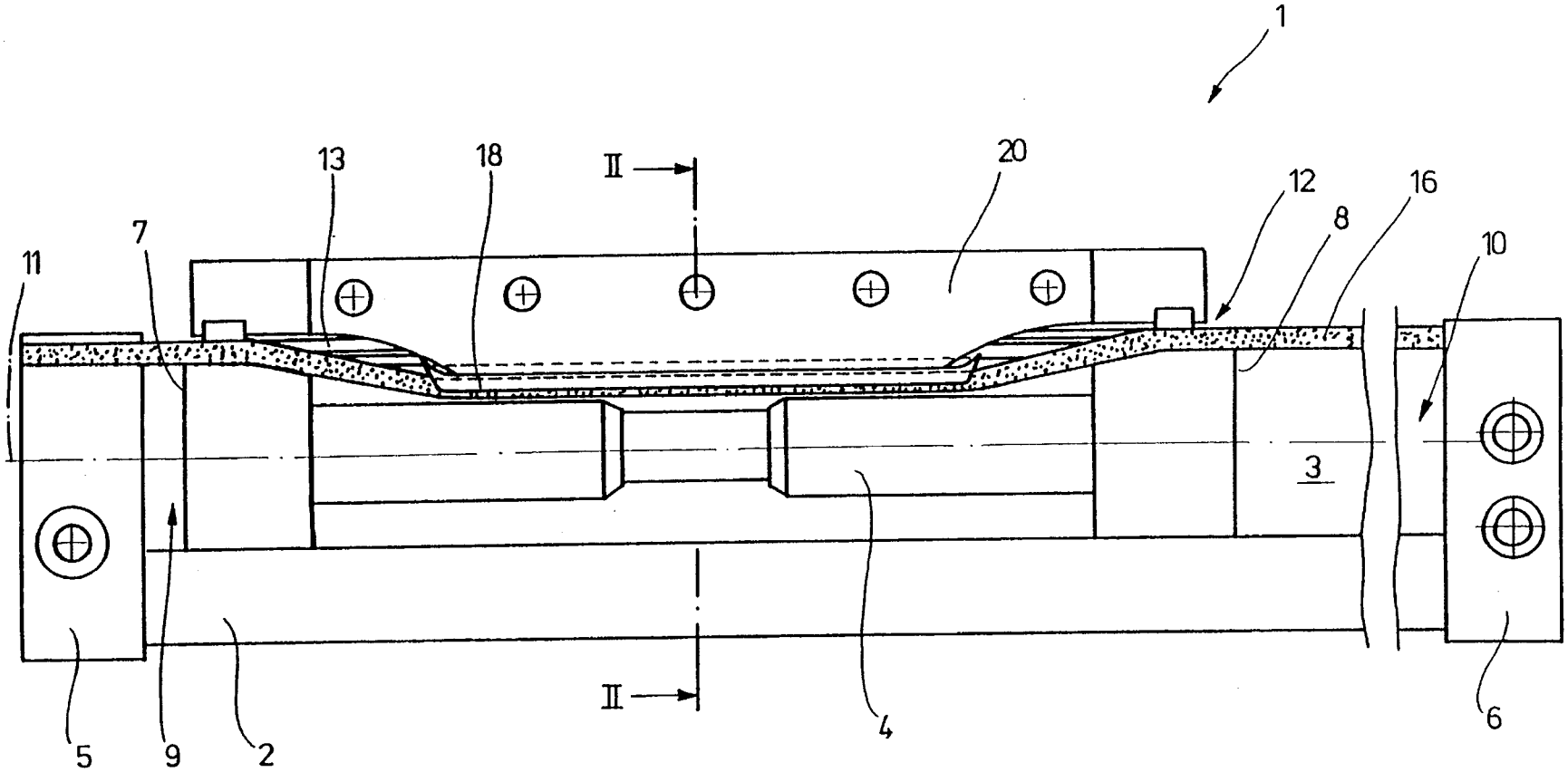
FIG. 1 shows a linear drive without a piston rod, with a sealing band held by a profile element, in a side view and in a partially cutaway and diagrammatic representation.

The separate profile element arranged in the longitudinal slot forms a catch device, by means of which the portion of the sealing band engaging into the longitudinal slot can be caught. The catch effect can be set, largely independently of the actual execution of the sealing band, by a suitable design and dimensioning of the profile element. Furthermore, it is possible to provide a family of linear drives for different pressures, working strokes and working speeds by the use of a unitary basic semifinished product for the guide tubes. Deviations which may be necessary in terms of the holding force of the sealing band can be allowed for by a suitable design of the particular profile element used. The sealing band is primarily responsible for sealing off the guide tube and can be optimized for this function in terms of the choice of material. In contrast, the separately provided profile element can be designed, both in its choice of material and in its geometrical form, in such a way that the sealing band is held optimally in the longitudinal slot. Finally, the wear of the sealing band can be reduced, because the latter undergoes only slight deformation when it is being led into and out of the longitudinal slot.

A secure fastening of the profile element in the longitudinal slot is obtained if the profile element is held positively. In addition, the profile element can be secured in the longitudinal slot nonpositively, that is to say, for example, by clamping, or integrally, for example by means of adhesive. Moreover, it is also possible to fasten the profile element in the longitudinal slot purely integrally, for example by means of adhesive. However, positive fixing is a simple and cheap solution, by means of which the profile element is held permanently and reliably.

For the positive fastening of the holding element in the longitudinal slot, the latter can be provided on its flank with at least one groove, in which the profile element is seated with one portion. The mounting of the profile element on the guide tube takes place simply as a result of the insertion of the profile element into the groove. According to the shape of the profile element, the groove can be of either rectangular or triangular or another shape. A decisive factor in any event is that the profile element is held securely in relation to the radial direction of the guide tube. To make a catching connection between the sealing band and the guide tube provided with the profile element, the sealing band can have, on at least one side facing the flank of the longitudinal slot, a longitudinal recess which extends over the entire length of the sealing band. This longitudinal recess is assigned a catch portion which is provided on the profile element and which projects beyond the flank of the longitudinal slot. When this catch portion is held resiliently in the direction of the groove, it snaps into the longitudinal recess of the sealing band when the latter lies in the longitudinal slot. When the sealing band is drawn out of the longitudinal slot inward, the catch portion of the profile element springs up and releases the sealing band. The latter does not undergo any appreciable deformation in the region of its longitudinal recess.

In one embodiment, the profile element has an oval cross-section and lies in a rectangular groove. At the same time, the profile element bears with its flat sides on two mutually parallel side walls of the groove and projects with its round catch portion into the longitudinal slot. This profile element is deformed in its cross-section during the catching operation. The catch portion of semicircular shape or in the form of a segment of a circle is pressed more or less flat and the profile element is pressed at least somewhat into the groove. A deformation of this type becomes possible, for example, when the profile element is made from sponge rubber.

Both the above-mentioned profile element of oval cross-section and other possible profile elements, such as, for example, round profile elements lying in a triangular or rectangular groove, can also be formed from a thin-walled flexible plastic hose.

It is possible, furthermore, to produce the profile element from a less flexible plastic or from metal. Thus, the profile element can be mounted in the groove so as to be resilient in relation to a direction away from the sealing band. One possibility for this is afforded if spring means are provided on the portion of the profile element seated in the groove. These spring means can be a multiplicity of individual springs, such as knobs or the like, located in the groove and spaced from one another over the length of the profile element. It is advantageous, however, if the spring means are legs supported on the groove and provided on the profile element. These legs form lips which extend over the entire length of the profile element and which can be resilient. Even only a slight permissible spring stroke of the legs is sufficient to convert the spring movement of the legs into a corresponding movement of the profile element into the groove or out of the groove by means of oblique faces. This can be achieved in that the legs bear on bearing faces which are provided in the groove and which form an angle opening toward the flank, the legs being pretensioned resiliently in the spreading direction. This profile element can be produced from plastic or from metal.

Finally, the profile element can have a catch portion which is designed as a resilient tongue or lip and which is arranged between the flank and the sealing band and is connected to the portion seated in the groove. The spring effect necessary for catching is brought about essentially by a deformation of the tongue. The tongue has bearing faces which are in contact with corresponding wedge faces provided on the sealing band. The inclination of the contact and wedge faces relative to the flank of the longitudinal slot determines the force necessary for the engagement and disengagement of the sealing band. Thus, by suitably fixing the inclination of the bearing and wedge faces, the catching force for engagement and disengagement can be set separately in each case.

For fastening the profile element, there can also be provided two grooves which extend parallel to one another and in which the profile element is seated with corresponding portions. The grooves can be both triangular or rectangular and be provided as open-edged grooves at the edges of the flank of the longitudinal slot. At all events, the possibility of a secure positive fastening of the profile element in the longitudinal slot is afforded.

It is especially advantageous if the profile element covers the flanks completely. In this case, the flanks are protected by the profile element. For example, the web, when it is pressed onto the profile element as a result of lateral pressure, does not damage the flanks. The profile element thus forms a run-on protection for the flanks. This run-on protection can also be ensured in that the profile element has at least one portion which bears fixedly on the flank and which is raised in relation to the remaining flank. Even if the flank is not covered completely, the portion provided on the profile element nevertheless ensures that the web cannot touch the noncovered parts of the flank. This results in reliable run-on protection.

The linear-drive module illustrated in FIG. 1 is a linear drive 1 without a piston rod, which has a guide tube 2, in which a piston 4 sealed off relative to its wall 3 is mounted so as to be slidably displaceable. The guide tube 2 is closed on its end faces by means of respective covers 5, 6, so that the piston 4 limits, with its end faces 7, 8, the wall 3 and the covers 5, two chambers 9, 10 which can be loaded with pressure medium, such as, for example, compressed air.

Figure 2:
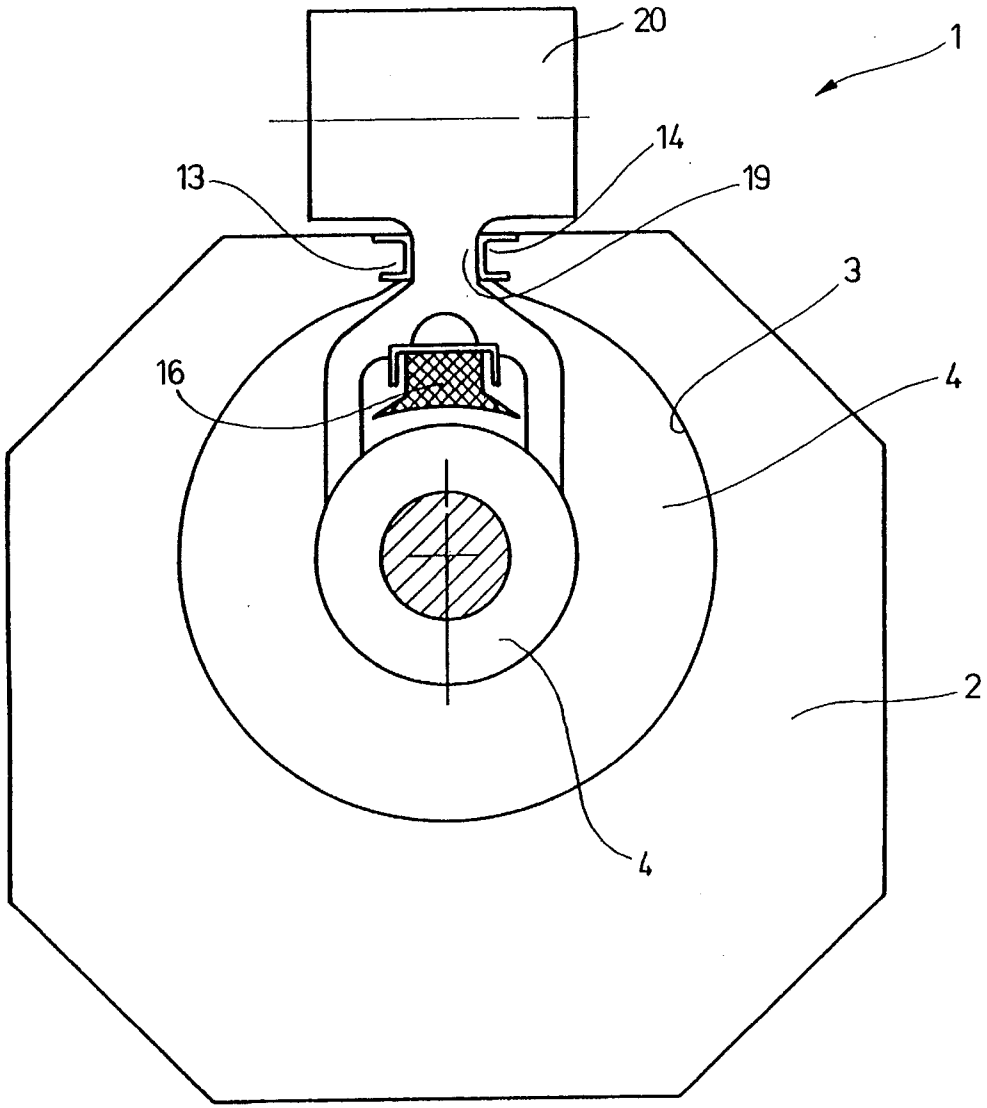
FIG. 2 shows the linear cylinder according to FIG. 1 in a sectional representation along the line II—II.

The guide tube 2 is provided with a longitudinal slot 12 which extends parallel to its longitudinal axis 11 and passes through the wall 3 and which is limited by two mutually opposite flanks 13, 14 which extend parallel to and at a distance from one another and which are evident particularly from FIG. 2 and from the following figures.

The longitudinal slot 12 is closed by means of a sealing band 16 which is held at its ends near the covers 5, 6 and which seals off the chambers 9, 10 near the longitudinal slot 12 by means of a sealing lip 17 bearing on the wall 3 of the guide tube 2. The inward curvature of the sealing lip 17 is identical to the curvature of the wall 3, so that the piston 4 is seated in a sealed-off manner on the sealing lip 17 in the same way as on the remaining wall 3. In a middle region of the piston 4, the sealing band 16 is drawn inward out of the longitudinal slot 12 by a guide device 18. As is evident from FIG. 2, there is provided in this region a forked web 19 which connects the piston 4 to an outer driven member 20 and through the fork of which the sealing band 16 is guided.

Figure 3:
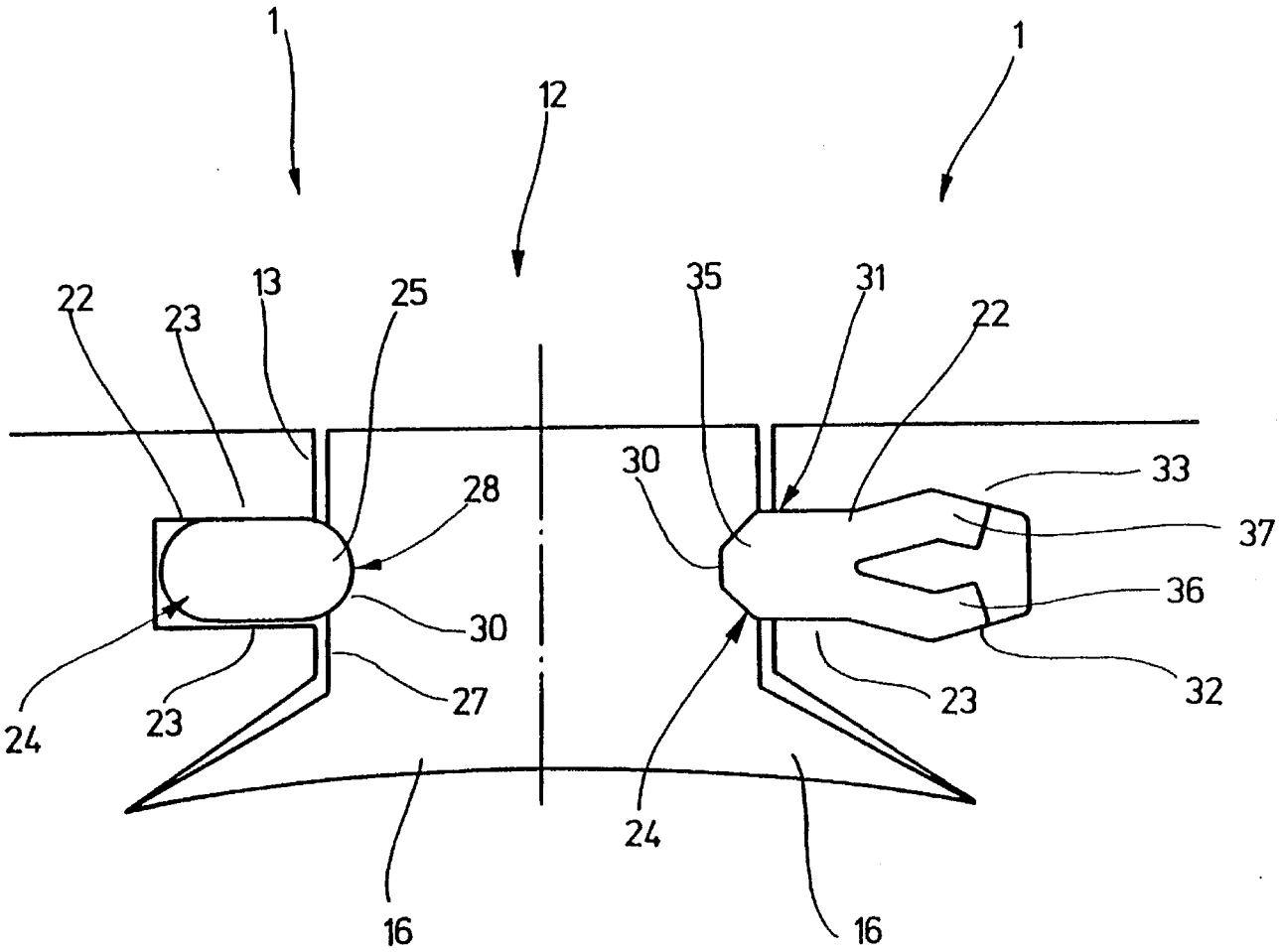
FIG. 3 shows the linear drive according to FIG. 2, with profile elements provided in the region of its longitudinal slot, in two different embodiments, in a cut-out representation and on an enlarged scale.

FIG. 3 shows in cutout form two possible embodiments of the linear drive 1 which differ in the design of the longitudinal slot 12 and of the sealing band 16. Both in FIG. 3 and in each of the remaining following figures, one embodiment is shown in the left-hand half of the figure and a further embodiment is shown in the right-hand half of the Figure. A feature common to all the embodiments is that there is provided in each flank 13, 14 a groove 22, in which a profile element 24 is held. In all the embodiments, the cross-section of the groove 22 provided in the flank 13 is identical to the cross-section of the groove 22 provided in the opposite flank 14.

To make easily understandable references possible, functionally identical parts and portions on different embodiments of the linear drive 1 bear the same reference symbols.

In the embodiment of the linear drive 1 shown on the left in FIG. 3, the groove 22 provided in the flank 13 is made rectangular. It has two mutually parallel side walls 23, between which the profile element 24 of oval cross-section is held. The profile element 24 is made from a flexible sponge rubber and has a catch portion 25 which projects into the longitudinal slot 12 and which has a cross-section essentially in the form of a segment of a circle.

The sealing band 16 lying with an essentially rectangular portion 26 in the longitudinal slot 12 has, on its side 27 located near the flank 13, a longitudinal recess 28 which is identical in cross-section to the cross-section of the portion 25 and which is therefore likewise in the form of a segment of a circle.

In the linear drive 1 thusfar described, a catching connection between the sealing band 16 and the guide tube is formed by means of the profile element 24 located in the longitudinal recess 28. The sealing band 16 located outside the region occupied by the piston 4 is thus held in the longitudinal slot 12 to such an extent that the sealing lip 17 bears on the wall 3 and the chambers 9, 10 are thus leakproof.

Furthermore, the profile element 24 affords some lateral run-on protection. The catch portion 25 thus acts at the same time as a run-on portion 30 which prevents the web from sliding along on the flank 13 and damaging the latter. However, at least in the case of a web made continuously flat, the protective effect is rather slight and depends on the spring effect of the profile element 24. To reinforce the lateral run-on protection, the web 19 can be provided with a projection which is located at the same height as the profile element 24 and which is supported on the catch portion 25 of the profile element 24.

In the cutout of the linear drive 1 shown in the right-hand half of FIG. 3, the groove 22 is designed, in the vicinity of its mouth 31, with parallel flanks, and adjacently to the portion with parallel flanks it first widens away from the mouth 31 and then narrows again. Portions of the side walls 23 thus form mutually opposite bearing faces 32, 33 which with one another form an acute angle opening toward the mouth 31.

The profile element 24, the catch portion 25 of which is trapezoidal here, is inserted into this groove 22. Provided on the portion of this profile element 24 seated in the groove 22 are two legs 36, 37 which form with one another an acute angle and which are made resilient and bear on the corresponding bearing faces 32, 33 of the groove 22.

The profile element 24 is made from a resilient plastic, so that, when the profile element 24 is pushed into the groove 22, the legs 36, 37 spring together and resiliently pretension the profile element 24 toward its position of rest shown in FIG. 3.

In this embodiment of the profile element, according to the cross-sectional shape of the catch portion 25, the longitudinal recess 28 provided in the sealing band 16 is likewise trapezoidal in an identical way to the trapezoidal catch portion 25.

In this embodiment thusfar described, the catch effect between the guide tube 2 and the sealing band 16 is likewise ensured by the effect of the profile element 24. In contrast to the exemplary embodiment of the left-hand side of FIG. 3 described above, however, the profile element 24 serving as a catch member is not deformed as a whole during the catching operation, but essentially only in the region of its legs 36, 37. Furthermore, the extent of the deformation is smaller, so that a plastic having lower flexibility can be used. Moreover, this profile element 24 too affords lateral run-on protection. This is true especially when the web is provided with a lateral longitudinal rib supported on the profile element 24. In particular, at the point when the profile element 24 is pressed completely into the groove 22 so that the legs 36, 37 bear on the bottom of the latter, the profile element 24 is a fixed abutment for the web 19.

Figure 4:
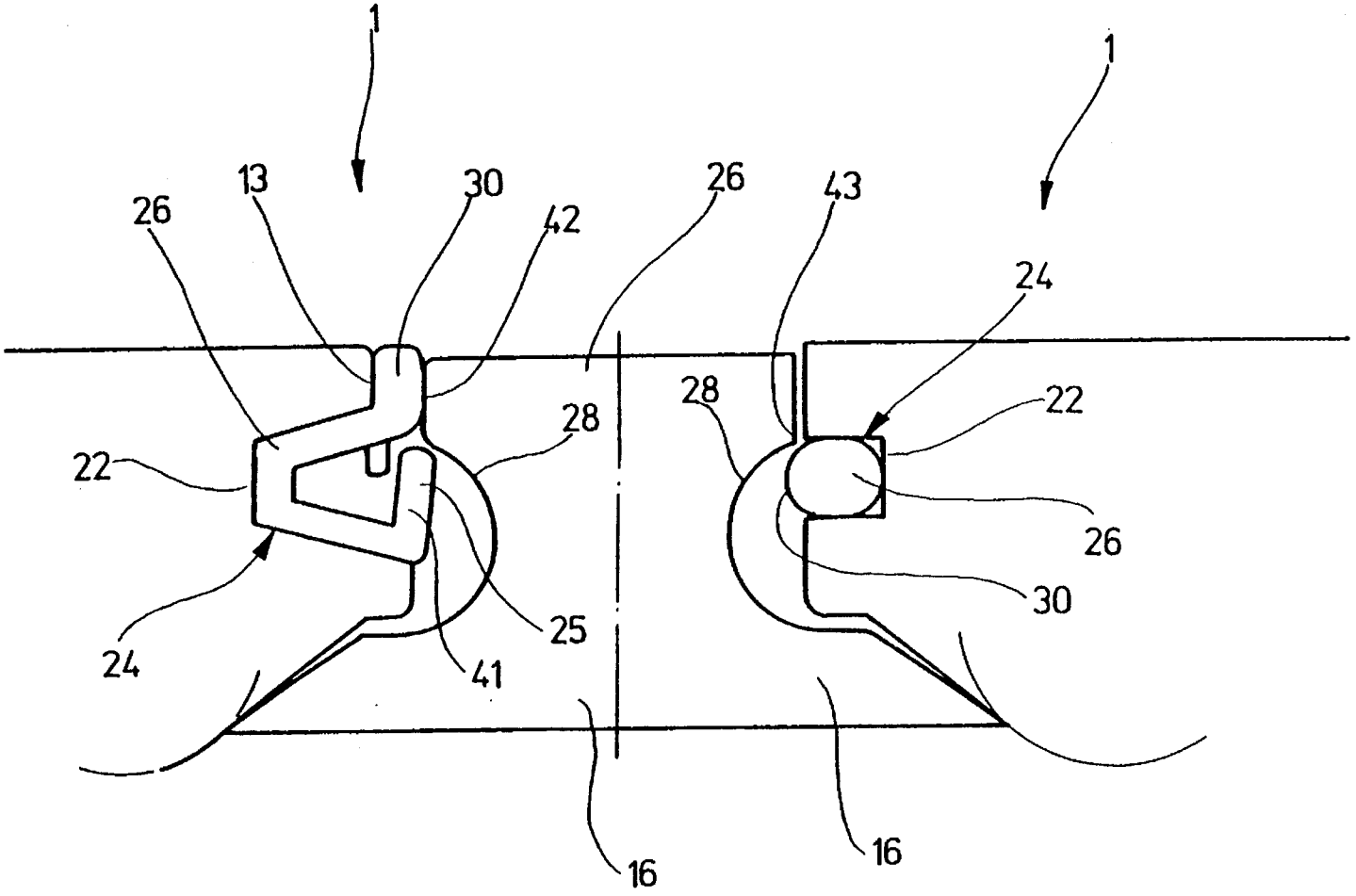
FIG. 4 shows the linear drive according to FIG. 2, with profile elements arranged in the region of its longitudinal slot, in two further embodiments.

In the linear drive 1 shown on the left in FIG. 4, the profile element 24 seated in a groove 22, trapezoidal here, has a run-on portion 30 separate from the catch portion 25. The catch portion 25 is a resilient tongue or lip 41 which is formed on the profile element 24, and which projects with a slight inclination relative to the flank 13 in the direction of the sealing band 16. In cooperation with the longitudinal recess 28 which is relatively deep in this embodiment, a catching connection is thus formed, and as a result of the slight inclination of the lip 41 relative to the flank 13 the sealing band 16 can be introduced into the longitudinal slot 12 with little force. As soon as the lip 41 is located in the longitudinal recess 28, the sealing band 16 is engaged firmly in the longitudinal slot 12, so that relatively great force is required in order to guide the sealing band 16 out of the longitudinal slot 12.

The separate run-on portion 30 bears on a somewhat set-back region of the flank 13 and projects into the longitudinal slot 12. It is dimensioned so that it bears on the portion 26 of the sealing band 16.

In this embodiment, especially good run-on protection is ensured by means of the profile element 24. The web 19, when it is loaded with a lateral force, comes to bear on the run-on portion 30 or, more precisely, on its run-on face 42 which is arranged essentially parallel to the flank 13. Because the run-on face 42 projects in relation to the flank 13 and consists of relatively rigid material, the web 19 bearing on the run-on face 42 cannot touch the flank 13. The latter is thus effectively protected against damage.

The sealing band 16 is made straight, that is to say plane, on its inside facing the piston 4. It is therefore deformed slightly, that is to say pressed outward, by the piston running through under the sealing band 16. The inside of the sealing band 16 at the same time assumes the curvature of the piston 4. In order to ensure a corresponding freedom of movement, the longitudinal recess 28 is given a relatively large dimension.

The exemplary embodiment of the linear drive 1 shown on the right in FIG. 4 corresponds largely to that shown on the left in FIG. 3. The difference is that the profile element 24 has an essentially round cross-section and the groove 22 a square cross-section. Furthermore, the recess 28 is substantially larger, so that, in the state of rest, the sealing band 16 bears only with an edge 43 on the profile element 24. Here too, as in the exemplary embodiment described above, the sealing band 16 is plane on its inside, so that it is pressed outward somewhat by the piston 4 running through. The longitudinal recess 28 at the same time allows a corresponding freedom of movement of the sealing band 16.

In this exemplary embodiment too, lateral run-on protection, albeit somewhat less pronounced, is ensured if a rib cooperating with the profile element 24, that is to say bearing on the latter, is provided on the web 19.

Figure 5:
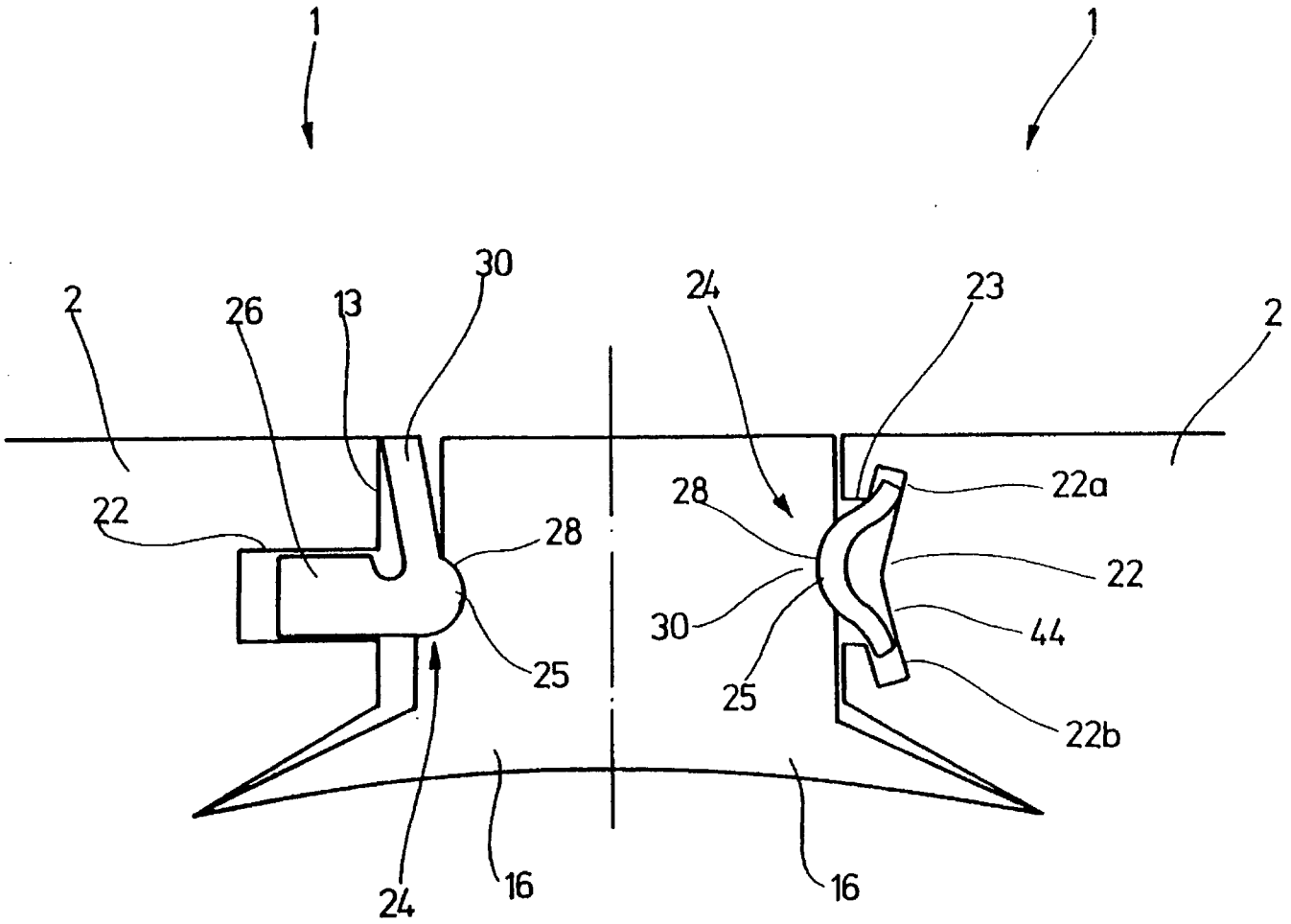
FIG. 5 shows the linear drive according to FIG. 2, with profile elements arranged in the region of its longitudinal slot, in two further embodiments.

In the linear drive 1 shown on the left in FIG. 5, a profile element 24 which ensures both a good catch effect and good run-on protection is used. The portion 26 located in the groove 22 is mounted so as to be displaceable in the direction perpendicular to the face of the flank 13. The catch portion 25 is in the form of a segment of a circle and lies in the correspondingly shaped longitudinal recess 28. Starting from the catch portion 25, the resiliently designed run-on portion 30 extends from the groove 22 over the portion of the flank 13 adjacent to the groove 22 and covers that portion. The run-on portion 30 projecting obliquely from the portion 26 in the position of rest is supported on the flank 13 and presses the catch portion 25 in the direction of the sealing band 16, so that the catch portion 25 is located firmly in the longitudinal recess 28.

The engagement and disengagement of the sealing band 16 takes place in a similar way to the exemplary embodiments described above. Moreover, the run-on portion 30 ensures that the flank 13 is protected against damage caused by the web 19 when the latter is pressed toward the flank 13. This is true especially when the profile element is produced from a tough and wear-resistant plastic.

In the exemplary embodiment shown on the right in FIG. 5, the groove 22 is provided with undercuts. In particular, the groove 22 has two side walls which extend parallel to and at a relatively large distance from one another and in which mutually opposite grooves **22*a*, 22*b*, each of rectangular cross-section, are once again made. The grooves 22*a*, 22*b* form with their side faces a roof-like bottom 44 of the groove 22. The bottom 44 has two portions which are at an obtuse angle opening away from the groove 22 in relation to one another. Supported on these portions of the bottom 44 is the profile element 24 which, in the state of rest, is a U-shaped strip. This lies with its legs in the grooves 22*a*, 22*b*, with the result that it is spread open. The profile element 24 consists of a flexible material, such as, for example, plastic, or also of a resilient sheet-metal strip. As a result of its spring effect, the profile element 24 is pressed somewhat out of the mouth 31 of the groove 22, so that it projects with its catch portion 25** out of the latter.

In this embodiment too, a catch effect between the sealing band 16 and the guide tube 2 and a run-on protection are achieved, as in the exemplary embodiments described above.

Figure 6:
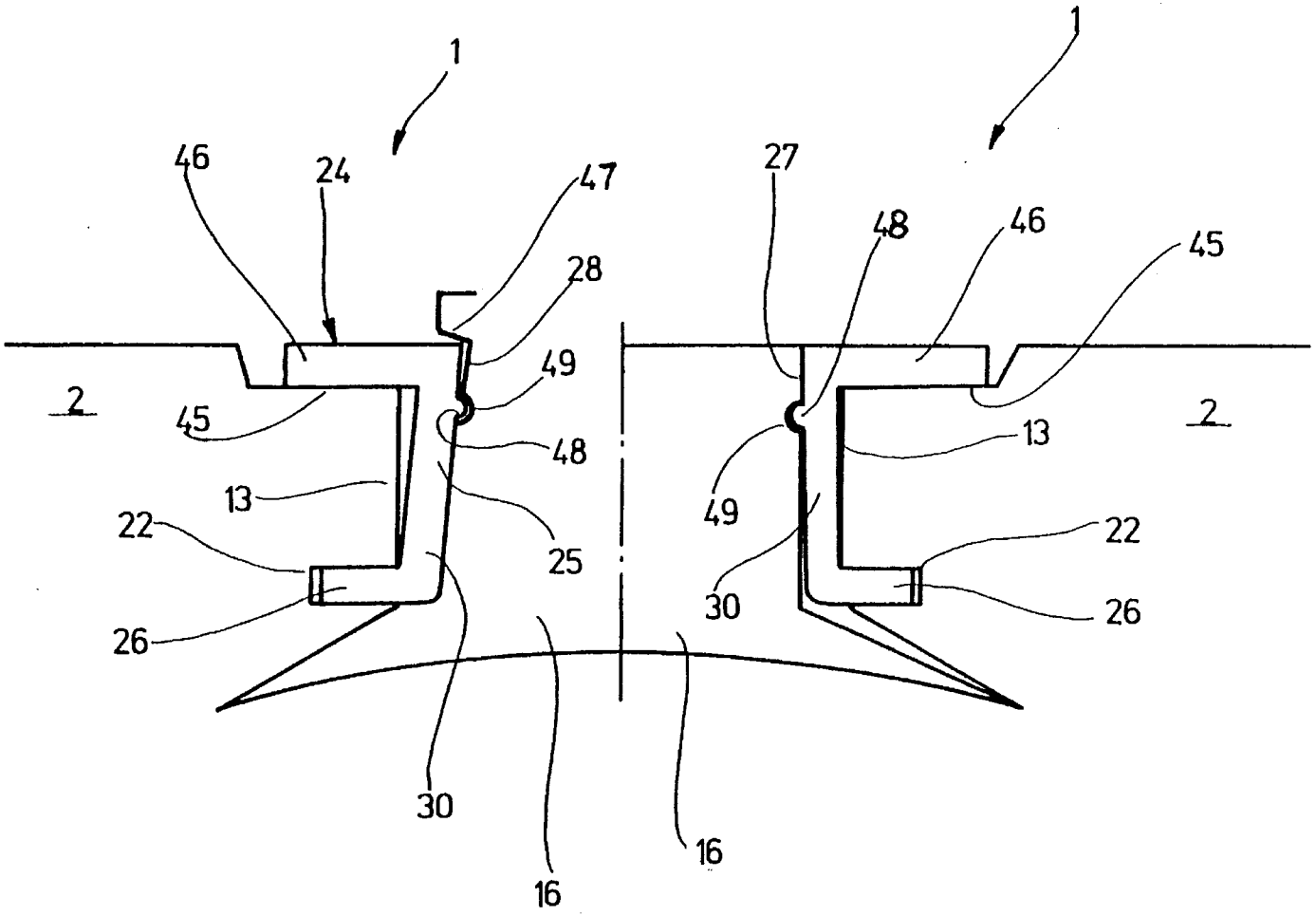
FIG. 6 shows the linear drive according to FIG. 2, in which the longitudinal slot has in its flanks two grooves, in which a profile element covering the flank is held, in two embodiments and in a cut-out diagrammatic representation.

FIG. 6 shows further exemplary embodiments, there being provided in the embodiment shown on the left, in addition to the groove 22, a second open-edged groove 45 which is arranged on the side of the flank 13 located opposite the groove 22. The profile element 24 has two portions 26, 46 which lie in the grooves 22, 45 and which are connected elastically to one another by means of the run-on portion 30. The run-on portion 30 covers the entire flank 13. In the state of rest, the portion 26 forms an obtuse angle with the run-on portion 30 and the portion 46 located in the open-edged groove 45 forms an acute angle with the run-on portion 30. As a result, in the region of the open-edged groove 45, the run-on portion 30 projects elastically in the direction of the sealing band 16, and at the same time it forms the catch portion 25.

The side 27 of the sealing band 16 is inclined relative to the flank 13 and above the run-on portion 30 merges by means of a step 47 into a larger width. The inclined side 27 and the step 47 together limit the longitudinal recess 28 in which the run-on portion 30 is located.

Especially good run-on protection is achieved in this embodiment because the flank 13 is covered completely by the run-on portion 30.

In addition, for example in order to improve the sealing-off of the sealing band, there can be provided on the run-on face 42 of the run-on portion a longitudinally extending rib 48 of semicircular cross-section which lies in a corresponding longitudinal flute 49 provided in the side 27 of the sealing band 16.

The embodiment shown on the right in FIG. 6 is largely identical to that shown on the left, but the side 27 of the sealing band 16 runs parallel to the flank 13 of the longitudinal slot 12. The sealing band 16 is flush relative to the outside with the guide tube 2 and with the portion 46 of the profile element 24 located in the open-edged groove 45. The catch effect is brought about essentially here by the cooperation of the rib 48 with the longitudinal flute 49.

Figure 7:
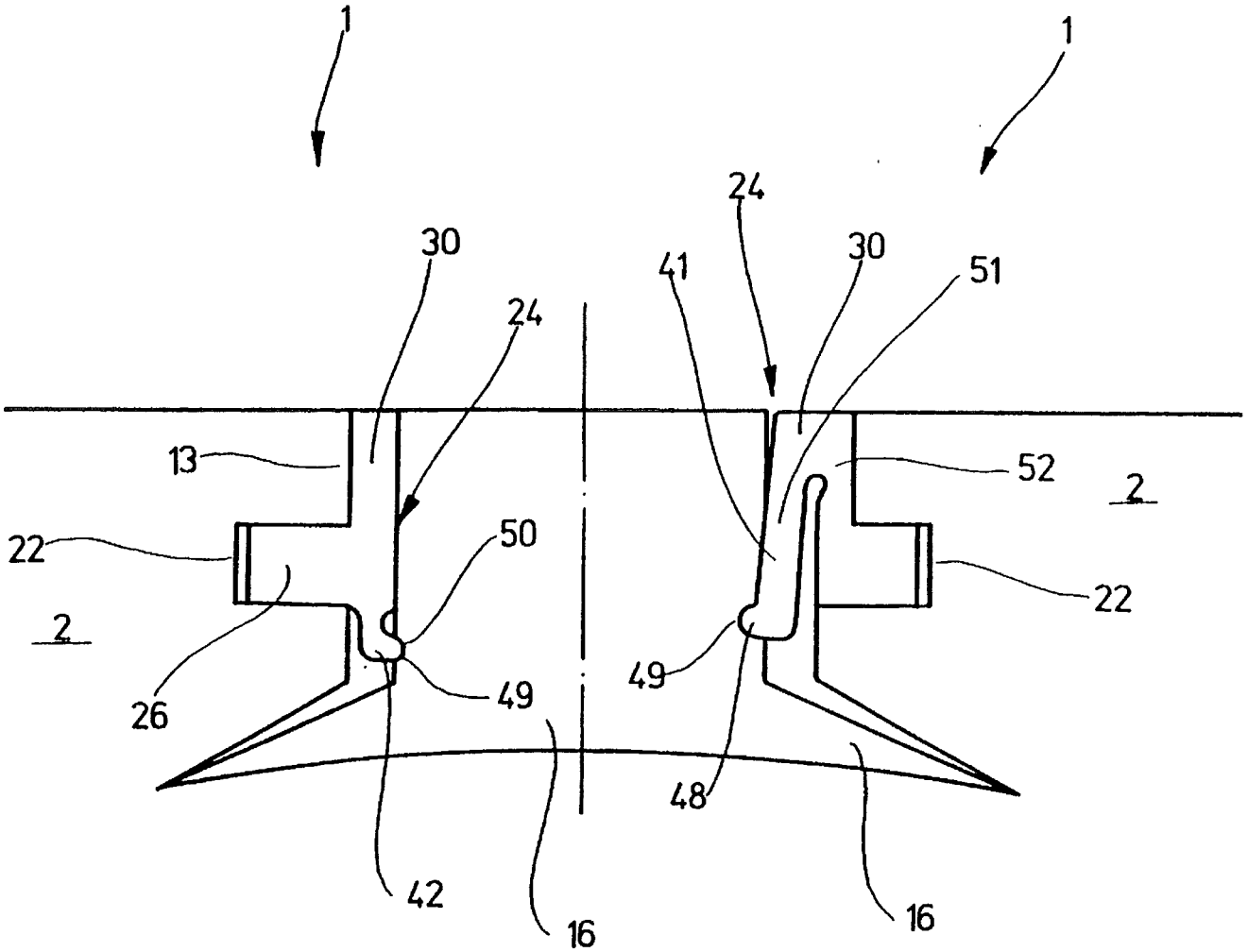
FIG. 7 shows the linear drive according to FIG. 2, in which the profile element seated in a groove has a resilient tongue for the retention of the sealing band, in two embodiments and in a cut-out diagrammatic representation.

The linear drive 1 shown on the left in FIG. 7 is largely identical in terms of construction to that shown on the left in FIG. 5, the run-on portion 30 bearing flat on the flank 13. The profile element 24 otherwise defining an angle profile in cross-section is held positively in the rectangular groove 22 and is essentially fixed in relation to the guide tube 2. The catch effect is brought about by the catch lip 42 which is made very short here and which lies with a catch nose 50 in the longitudinal flute 49 provided in the sealing band 16.

Good run-on protection is achieved because the flank 13 is covered virtually completely by the profile element 24, the attainable catch effect being capable of being varied by means of an appropriate design of the lip 42.

In the linear drive 1 shown on the right in FIG. 7, there is formed on the profile element 24 lying in the rectangular groove 22 a flexural spring 51, the first leg 52 of which bears flush on the somewhat set-back flank 13 and the other leg of which is formed by the lip 41 which is connected continuously to the leg 52 on the outside of the linear drive 1.

Figure 8:
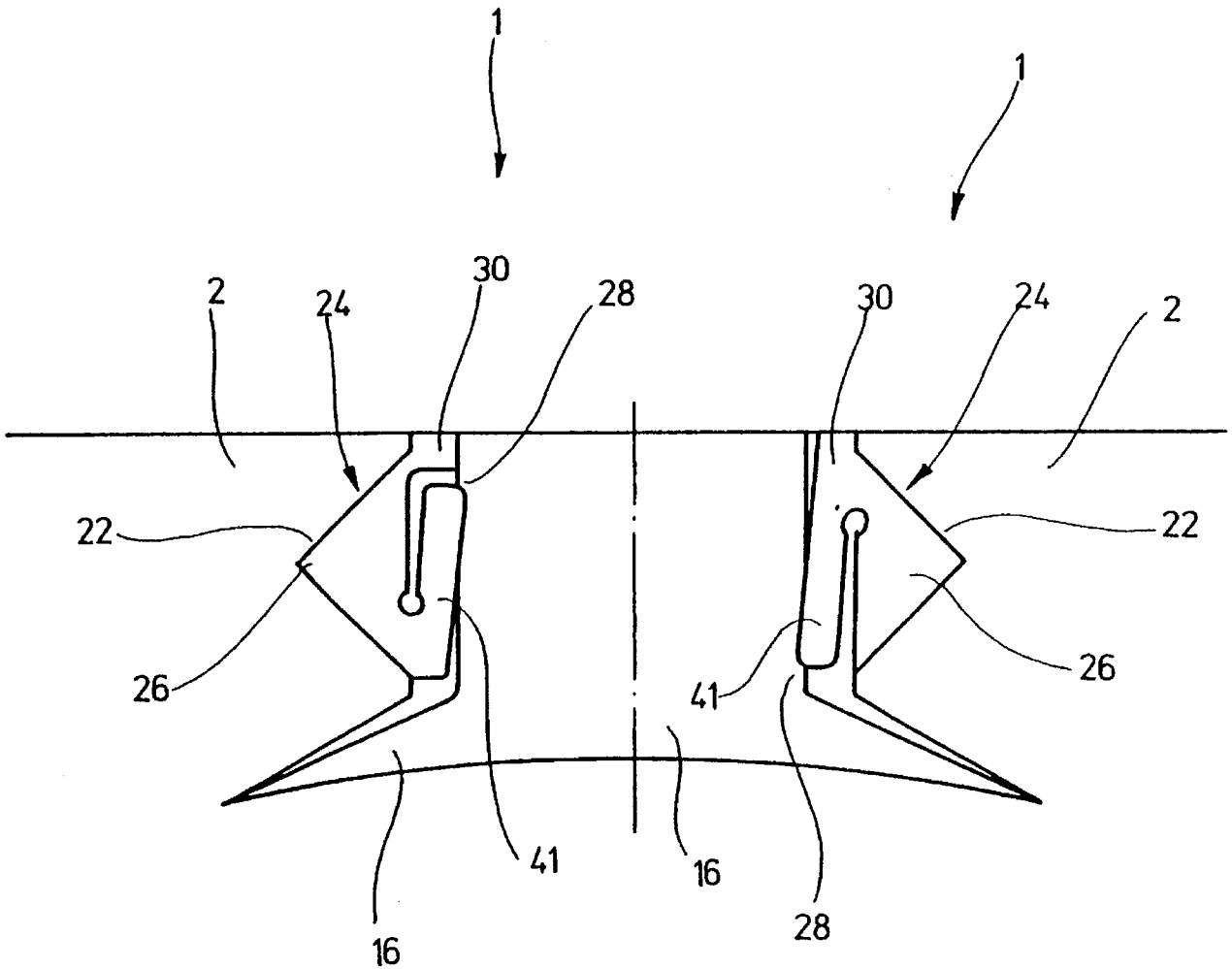
FIG. 8 shows the linear drive according to FIG. 2, in which the profile element seated in a groove has a resilient tongue for the retention of the sealing band, in two embodiments and in a cut-out diagrammatic representation.

Further embodiments of the linear drive 1 which ensure both a run-on protection and a catch function are shown in FIG. 8. The profile element 24 lies in the groove 22 which is designed here with a triangular cross-section and in which the likewise triangular portion 26 is seated. As shown, the latter can be both made solid and provided with a longitudinal groove which increases the elasticity of the portion 26. Here, the run-on portion 30 and the lip 41 are arranged on mutually opposite sides of the portion 26.

However, as shown on the right in FIG. 8, the lip 41 can also be directly connected elastically to the run-on portion 30.

Figure 9:
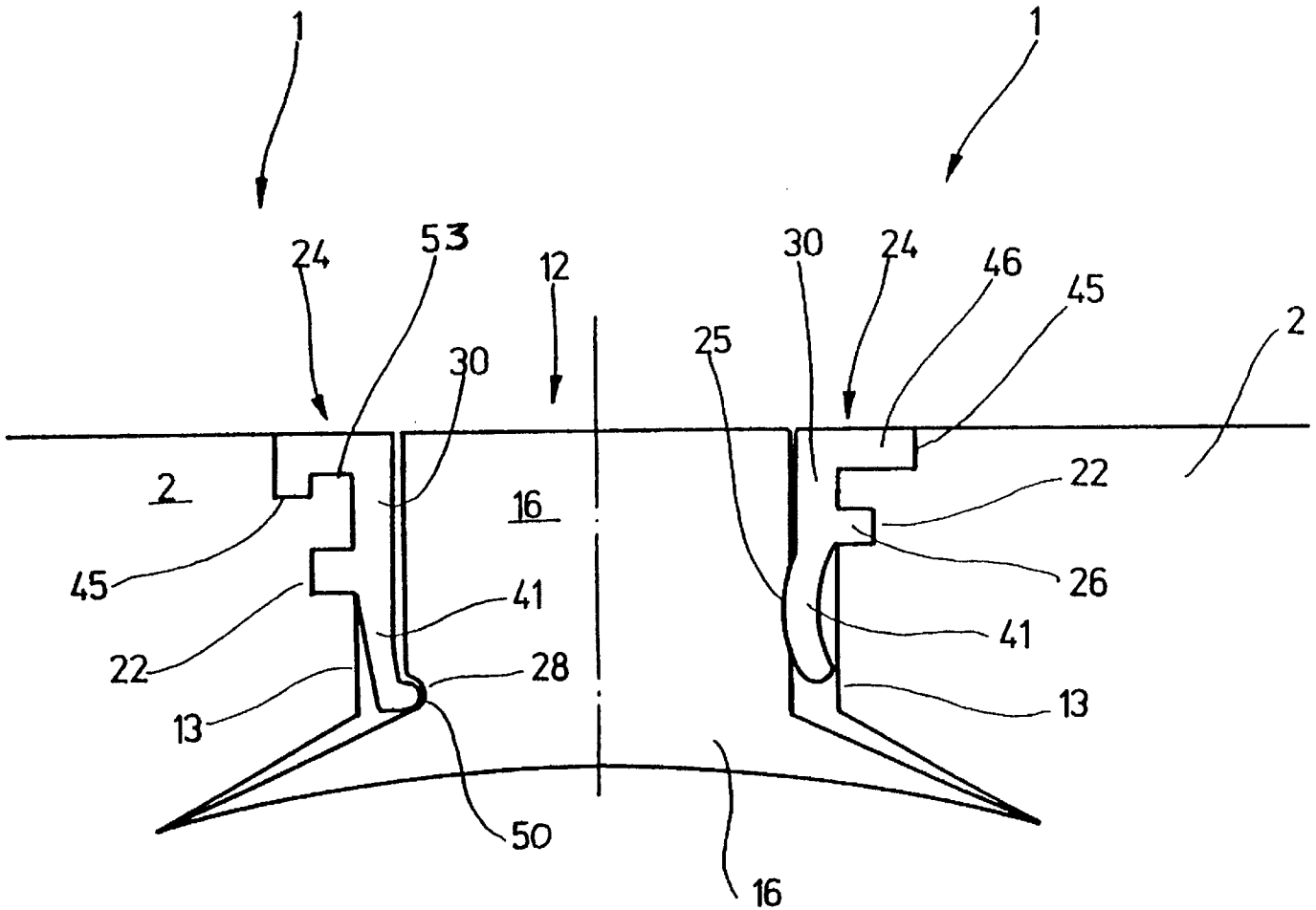
FIG. 9 shows the linear drive according to FIG. 2, in which the profile element is held in two grooves extending parallel to one another.

A further embodiment is shown in the left-hand half of FIG. 9. Here, the open-edged groove 45 is provided, on its side adjacent to the flank 13, with a longitudinally extending projection 53, so that, as seen from the longitudinal slot 12, an undercut is obtained in the groove 45. The profile element 24 bears in the two grooves 22, 45 and is aligned both with the outside of the guide tube 2 and with the outer side of the sealing band 16. The lip or tongue 41 extends from the portion of the profile element held fixedly by the grooves 22, 45 in the direction of the piston 4 in an approximately radial direction. The lip 41 does not bear on the flank 13, but projects from this in the longitudinal slot 12.

The lip 41 is provided on the end face with the catch nose 50 which extends over its entire length and which lies in the here flute-shaped longitudinal recess 28, with the result that the sealing band 16 is caught together with the guide tube 2. Run-on protection is ensured, here, by the run-on portion 30 extending between the grooves 22, 45.

The linear drive 1 shown on the right in FIG. 9 is largely identical to that shown on the left, the undercut in the open-edged groove 45 having been dispensed with. Moreover, the flexible lip 41 is made curved, so that it is supported with its free end on the flank 13. It is arched into the longitudinal slot 12, this projecting portion forming the catch portion 25 which, here, is approximately in the form of a segment of a circle.

Figure 10:
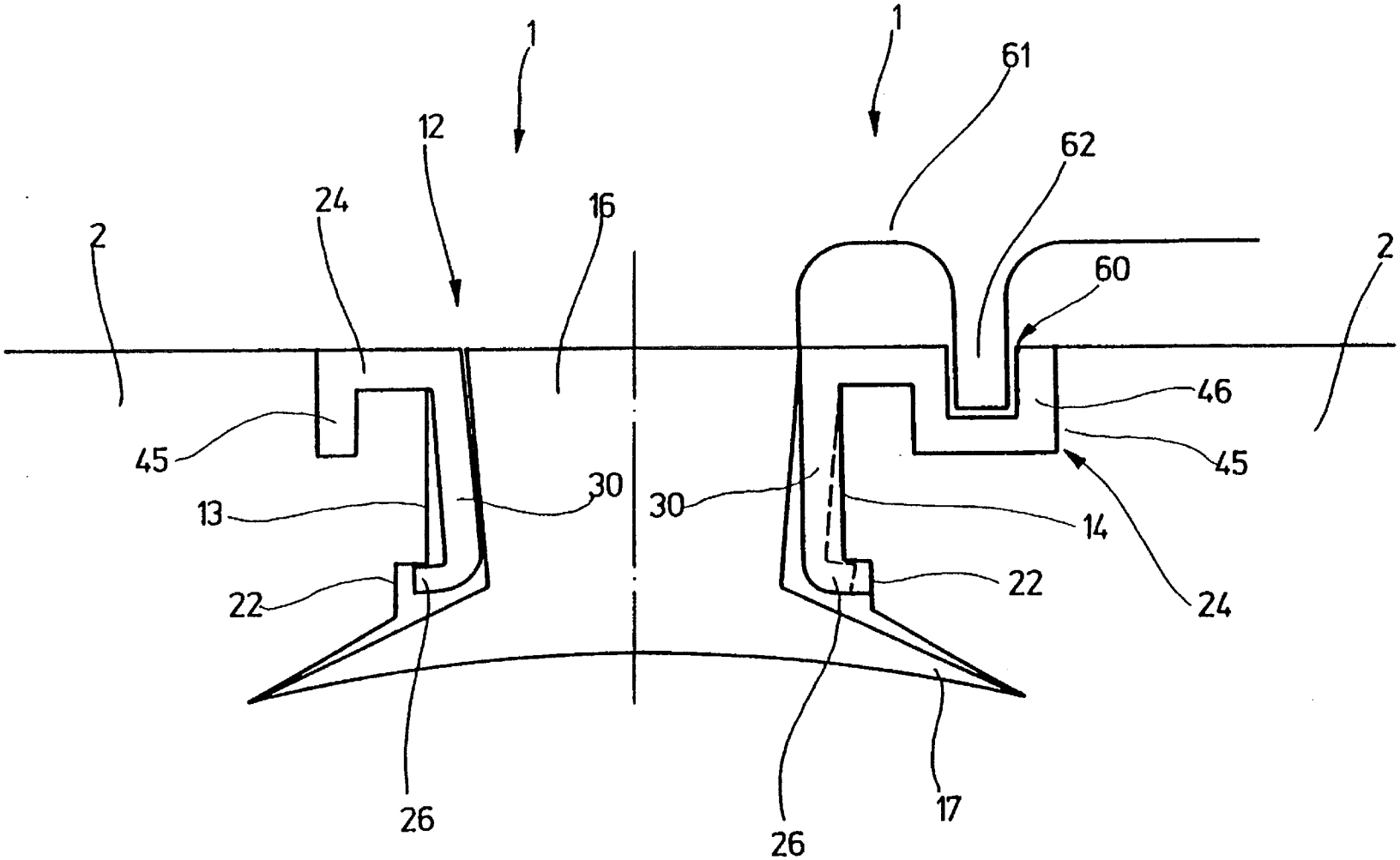
FIG. 10 shows the linear drive according to FIG. 2, in which the profile element seated in two mutually parallel grooves completely covers the flank of the longitudinal slot, in two embodiments, an additional sealing-off means designed as a labyrinth seal being provided in one embodiment.

In the exemplary embodiments of the linear drive 1 which are shown in FIG. 10, an especially secure fastening of the profile element 24 is ensured by an undercut in the open-edged groove 45. In both exemplary embodiments, the groove 22 is likewise designed as an open-edged groove. The resiliently designed run-on portion 30 extends from the portion of the profile element 24 located in the groove 45 in the direction of the open-edged groove 22, into which it engages with a short portion. The run-on portion 30 is pretensioned resiliently away from the flank 13, so that a catch effect is obtained for the trapezoidally designed portion of the sealing band 16 located in the longitudinal slot. Moreover, good run-on protection is achieved.

In the linear drive 1 shown on the right in FIG. 10, the profile element 24 has an outwardly opened sealing groove 60 on the portion 46 located in the groove 45. The sealing groove 60, together with a projection provided on a covering band 61 or a slide, forms a labyrinth seal. An additional improved sealing-off of the linear drive 1 is thereby achieved.

In any of its embodiments, the profile element 24 can be used as a run-on protection element both on linear drives 1 actuated by a pressure medium and on those linear drives which are driven via pull means, screw-spindle mechanisms or racks.

While the invention has been disclosed with reference to certain described embodiments, numerous alterations, modifications, and changes to the described embodiments are possible without departing from the spirit and scope of the invention, as defined in the appended claims and equivalents thereof.

What is claimed is:

1. A linear drive, comprising:

a guide tube having a longitudinal slot defined therein by at least one flank, and at least one closing device for closing an end face of the guide tube;

a piston mounted in the guide tube and displaceable in a longitudinal direction;

a web connected to the piston and passing through the longitudinal slot;

a sealing band for sealing the longitudinal slot at least in pressurized regions and which is held fixedly at end faces relative to the guide tube, at least one portion of the sealing band being seated in the longitudinal slot; and at least one separate profile element disposed in the longitudinal slot and extending essentially along a longitudinal extension of the flank of the longitudinal slot;

wherein the profile element is connected to the sealing band such that a catching connection is formed between the sealing band and the guide tube.

2. The linear drive as claimed in claim 1, wherein the profile element is connected to the flank.

3. The linear drive as claimed in claim 1 wherein the flank of the longitudinal slot includes at least one groove and wherein the profile element includes a portion seated in the groove.

4. The linear drive as claimed in claim 1, wherein a side of the sealing band facing the flank of the longitudinal slot includes a longitudinal recess extending over an entire length of the sealing band.

5. The linear drive as claimed in claim 4, wherein the profile element includes a catch portion which extends into the longitudinal recess.

6. The linear drive as claimed in claim 5, wherein the catch portion is held resiliently in a direction toward the flank.

7. The linear drive as claimed in claim 3, wherein the profile element has an oval cross-section.

8. The linear drive as claimed in claim 7, wherein the groove has a rectangular cross-section.

9. The linear drive as claimed in claim 8, wherein flat sides of the profile element bear on mutually parallel side walls of the groove and wherein the profile element includes a round catch portion which projects into the longitudinal slot.

10. The linear drive as claimed in claim 1, wherein the profile element is made from sponge rubber.

11. The linear drive as claimed in claim 1, wherein the profile element is a thin-walled flexible plastic hose.

12. The linear drive as claimed in claim 1, wherein the profile element is connected to the flank by adhesive.

13. The linear drive as claimed in claim 3, wherein the profile element is mounted in the groove resiliently in relation to a direction away from the sealing band.

14. The linear drive as claimed in claim 3, wherein the portion of the profile element seated in the groove includes spring means.

15. The linear drive as claimed in claim 14, wherein the spring means are legs supported on the groove.

16. The linear drive as claimed in claim 15, wherein the legs extend over an entire length of the profile element.

17. The linear drive as claimed in claim 15, wherein the legs bear on bearing faces in the groove, the bearing faces form an angle that opens toward the flank, and the legs are pretensioned resiliently in a direction toward the bearing faces.

18. The linear drive as claimed in claim 3, wherein the profile element includes a catch portion in the form of a resilient tongue or lip wherein the catch portion is disposed between the flank and the sealing band and is connected to the portion of the profile element seated in the groove.

19. The linear drive as claimed in claim 1, wherein the flank includes two grooves and the profile element includes two portions seated in the two grooves, respectively.

20. The linear drive as claimed in claim 1, wherein the profile element completely covers the flank.

21. The linear drive as claimed in claim 1, wherein the profile element includes at least one portion which bears fixedly on the flank and which is raised in relation to the flank.

* * * * *